US010479552B2

(12) United States Patent
Balazs et al.

(10) Patent No.: US 10,479,552 B2
(45) Date of Patent: Nov. 19, 2019

(54) PLASTIC CONTAINER WITH LIFT HANDLE FOR FORK TRUCK TRANSPORT

(71) Applicant: ORBIS Corporation, Oconomowoc, WI (US)

(72) Inventors: Donald J. Balazs, Oconomowoc, WI (US); Link Jay Greiveldinger, Menomonee Falls, WI (US); Scott J. Buss, Watertown, WI (US); Joachim Banik, Oconomowoc, WI (US)

(73) Assignee: ORBIS Corporation, Oconomowoc, WI (US)

( * ) Notice: Subject to any disclaimer, the term of this patent is extended or adjusted under 35 U.S.C. 154(b) by 411 days.

(21) Appl. No.: 15/057,328

(22) Filed: Mar. 1, 2016

(65) Prior Publication Data

US 2016/0257445 A1 Sep. 8, 2016

Related U.S. Application Data

(60) Provisional application No. 62/129,142, filed on Mar. 6, 2015.

(51) Int. Cl.
*B65D 19/18* (2006.01)
*B65D 19/04* (2006.01)

(52) U.S. Cl.
CPC ..... *B65D 19/04* (2013.01); *B65D 19/18* (2013.01); *B65D 2519/00034* (2013.01); *B65D 2519/00069* (2013.01); *B65D 2519/00174* (2013.01); *B65D 2519/00422* (2013.01); *B65D 2519/00497* (2013.01); *B65D 2519/00621* (2013.01); *B65D 2519/00666* (2013.01); *B65D 2519/00791* (2013.01); *B65D 2519/00796* (2013.01); *B65D 2519/00975* (2013.01)

(58) Field of Classification Search
CPC ..... B65D 19/40; B65D 23/10; B65D 23/104; B65D 25/28; B65D 25/2802; B65D 19/04
USPC ..... 220/752, 759, 768, 755, 756, 769, 770, 220/775, 776
See application file for complete search history.

(56) References Cited

U.S. PATENT DOCUMENTS 4,232,916 A * 11/1980 Correia ..... A47B 47/042 108/53.3
4,735,331 A * 4/1988 Keenan ..... B65D 11/1833 220/1.5
4,809,851 A * 3/1989 Oestreich, Jr. ..... B65D 7/32 206/511

(Continued)

FOREIGN PATENT DOCUMENTS

DE 102004012198 A1 9/2005
WO 00027716 A1 5/2000

OTHER PUBLICATIONS

Canadian Patent Office, First Office Action for Application No. CA 2922429, dated Mar. 16, 2017 (4 pages).

*Primary Examiner* — Jeffrey R Allen
(74) *Attorney, Agent, or Firm* — Greensfelder, Hemker & Gale, P.C.

(57) ABSTRACT

A plastic tote style container having a first handle connected to an upper portion of a first end wall and a second handle connected to an upper portion of a second side wall is provided. The first and second handles are sized and positioned to form openings between the handles and the end walls that can accept a single tine of a fork truck or other similar device. This allows for carrying heavier loads in the tote style container.

20 Claims, 7 Drawing Sheets

(56) References Cited

U.S. PATENT DOCUMENTS

| | | | | |
|---|---|---|---|---|
| 5,555,980 | A * | 9/1996 | Johnston | B65D 19/18<br>206/386 |
| 7,269,969 | B2 * | 9/2007 | Strickland | B65D 25/282<br>220/592.16 |
| 7,484,621 | B2 * | 2/2009 | Apps | B65D 21/062<br>206/506 |
| 7,975,865 | B2 | 7/2011 | Marcel | |
| 2003/0230510 | A1 * | 12/2003 | Aiken | B65D 21/062<br>206/506 |

* cited by examiner

PLASTIC CONTAINER WITH LIFT HANDLE FOR FORK TRUCK TRANSPORT

CROSS-REFERENCE TO RELATED APPLICATIONS

The present invention claims the benefit of U.S. Provisional Patent Application No. 62/129,142 filed Mar. 6, 2015, the contents of which are incorporated herein by reference.

FEDERALLY SPONSORED RESEARCH OR DEVELOPMENT

N/A.

FIELD OF THE INVENTION

The present invention generally relates to a tote style container that can be used with material handling equipment, and more particularly to a tote style container having lift handles configured to be engageable by a tine of a fork lift or similar device.

BACKGROUND OF THE INVENTION

A number of different types of containers are used to transport and store bulk products or parts. One type of container is a hand held tote style container (or simply "tote"). Tote style containers require an operator to personally carry the container, and are thus limited to the weight that can be handled by the operator—typically in the range of 35-50 lbs. to prevent work related injuries to the operator.

Another type of container is a bulk bin container (sometimes "bulk bin"). Bulk bins are much larger than tote containers and are not lifted by the operator. Instead, bulk bin containers are used for heavier and/or larger loads. Such containers are sized for ease of use with handling equipment and are lifted by auxiliary means, typically lift trucks and hand jacks. Bulk bin containers generally weigh 50-150 lbs. when empty, and can typically carry 1000 lbs. or more when filled. The handling equipment is needed for either case.

In certain instances, it would be beneficial to load totes with heavier loads and utilize handling equipment with such totes rather than utilizing the much larger bulk bin containers. The present system provides an improved tote container that can be utilized with handling equipment.

SUMMARY OF THE INVENTION

The present invention provides a tote style container configured to provide a two point, top lifting method strong enough to support a full load when lifted and/or transported by a fork truck. Specifically, the container includes two handles mounted to the container body that are sized and positioned to receive a tine of the fork truck. This provides containers that are light enough to be lifted by hand when empty, and that can be used to transport loads greater than an operator can comfortably or safely handle on their own. This provides increased flexibility for transporting loads.

In accordance with one embodiment of the invention, a tote style container configured to receive a fork truck tine is provided. The container comprises a tote style container comprising a container body having a base, a first side wall, an opposing second side wall, a first end wall and an opposing second end wall. The container includes a first handle having an upper portion. The first handle is mounted to a top portion of the first end wall and forms a first opening between the top portion of the first end wall and the upper portion of the first handle. The container also includes a second handle having an upper portion. The second handle is mounted to a top portion of the second end wall and forms a second opening between the top portion of the second end wall and the upper portion of the second handle. The second opening is aligned with the first opening, and the first handle and the second handle are positioned and sized to receive a tine of a fork truck through the first opening and second opening.

The container is preferably formed from plastic. Each of the end walls and side walls can include a plurality of outwardly extending ribs. Additionally, the side walls and/or end walls can include one or more flat portions. The flat portions can be used for labels.

The first and second handles can be formed from metal. Additionally, the handles can be mounted to the first and second end walls by screws, bolts or other similar means.

The handles can be provided with flat horizontally extending segments. The flat segments can facilitate engagement with a fork tine and provide additional stability to the container during transport by the tine.

In accordance with another embodiment of the invention, a tote style container comprises a container body having a rectangular base, a first side wall, an opposing second side wall, a first end wall and an opposing second end wall, a first corner portion extending upward from the first end wall and the first side wall, a second corner portion extending upward from the first end wall and the second side wall, a third corner portion extending upward from the second end wall and the first side wall and a fourth corner portion extending upward from the second end wall and second side wall. A first handle is connected to the first end wall. The first handle has a horizontal bar extending from the first corner portion to the second corner portion to form an opening between the horizontal bar of the first handle and the first end wall. A second handle is connected to the second end wall. The second handle has a horizontal bar extending from the third corner portion to the fourth corner portion to form an opening between the horizontal bar of the second handle and the second end wall. The first opening and second opening are sized to receive a tine of a fork truck.

A top of the horizontal bar of the first handle can be level (i.e., flush) with a top of the first corner portion and second corner portion. Similarly, a top of the horizontal bar of the second handle can be level with a top of the third corner portion and fourth corner portion.

The horizontal bar of the first handle portion can include an upper planar portion and a lower planar portion substantially perpendicular to the upper planar portion. The lower planar portion extends toward an interior of the container and provides additional surface area for contacting the fork truck tine. Again, the horizontal bar of the second handle portion can also include an upper planar portion and a lower planar portion substantially perpendicular to the upper planar portion extending toward an interior of the container.

The horizontal bar of the first handle portion can include a first arm extending downward from a first end of the horizontal bar and a second arm extending downward from a second end of the horizontal bar. Again, the horizontal bar of the second handle portion can also include a first arm extending downward from a first end of the horizontal bar and a second arm extending downward from a second end of the horizontal bar.

The first end wall, second end wall, first side wall and second side wall can include a plurality of ribs extending outward. This provides additional strength and support for the container body.

The container body can further comprise a plurality of feet extending downward from the base. Additionally, the container body can include a first stringer and a second stringer. The first stringer can connect a first foot, a second foot and a third foot proximate the first side of the container and the second stringer can connect a first foot, a second foot and a third foot proximate the second side of the container. The string, feet and base can form a first opening and a second opening.

The horizontal bar of the first handle can be connected to a first angled portion extending downwardly on a first side and a second angled portion extending downwardly on a second side. The first angled portion can be further connected to a downwardly extending vertical portion that is secured to the first end wall and the second angled portion can be further connected to a downwardly extending vertical portion that is secured to the first end wall. Again, the second handle can be configured accordingly.

Further aspects of the invention are disclosed in the Figures and are described herein.

BRIEF DESCRIPTION OF THE DRAWINGS

To understand the present invention, it will now be described by way of example, with reference to the accompanying drawings and attachment in which.

DETAILED DESCRIPTION

Figure 1:
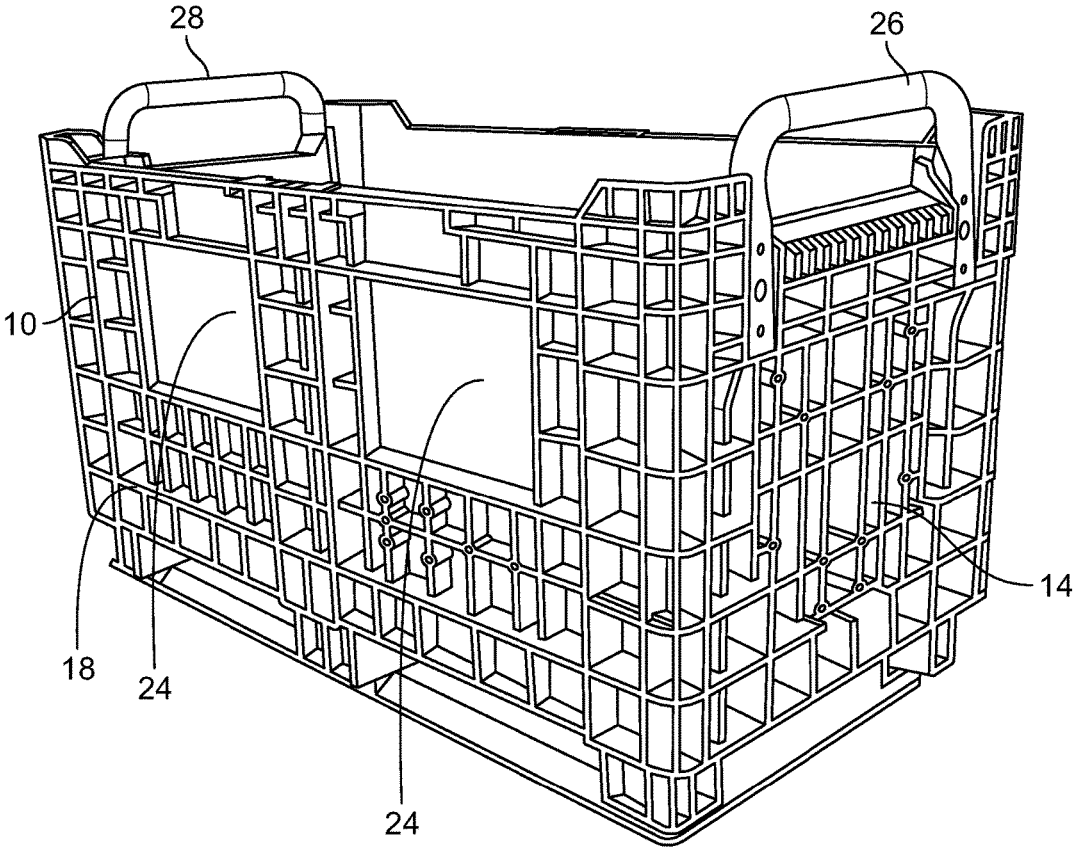
FIG. 1 is a perspective view of one embodiment of a tote style container with lift handles for a fork tine in accordance with the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIG. 1 shows a molded plastic, tote style container 10 in accordance with one embodiment of the present invention. The container 10 includes a generally rectangular base 12 having a first end wall 14, an opposing second end wall 16, a first side wall 18 and an opposing second side wall 20. The end walls 14, 16 and side walls 18, 20 extend upward from the base 12 to an open end.

Each of the end walls 14, 16 and side walls 18, 20 of the container 10 include a plurality of ribs 22 extending outward. The ribs provide strength without unduly adding weight to the container 10. The walls (here the side walls 18, 20) can also include flat regions 24. The flat regions 24 can be used for labels or cards.

The container 10 also includes a first handle 26 mounted to the first end wall 14, and a second handle 28 mounted to the second end wall 16. The handles 26, 28 are mounted to the end walls 24, 26 by screws, bolts or other similar mechanisms. Each handle 26, 28 includes a substantially vertical first arm 30, a substantially vertical second arm 32 and a substantially horizontal bar 34 connected to each arm 30, 32 to form a generally upside down U-shape. The vertical arms 30, 32 and horizontal bar 34 form an opening 35 with the remainder of the end walls 14, 16, and are sized and positioned to accept a tine from a fork lift or other similar mechanism through the openings. In this manner, the fork lift can be used to lift the container 10 using the handles 26, 28.

The container 10 is sized to enable an operator to lift the container using the first and second handles 26, 28 when the container is empty or loaded with a reasonable weight (i.e., one that does not require use of the fork lift). Accordingly, the first and second side walls 18, 20 should only extend about shoulder length.

Figure 2:
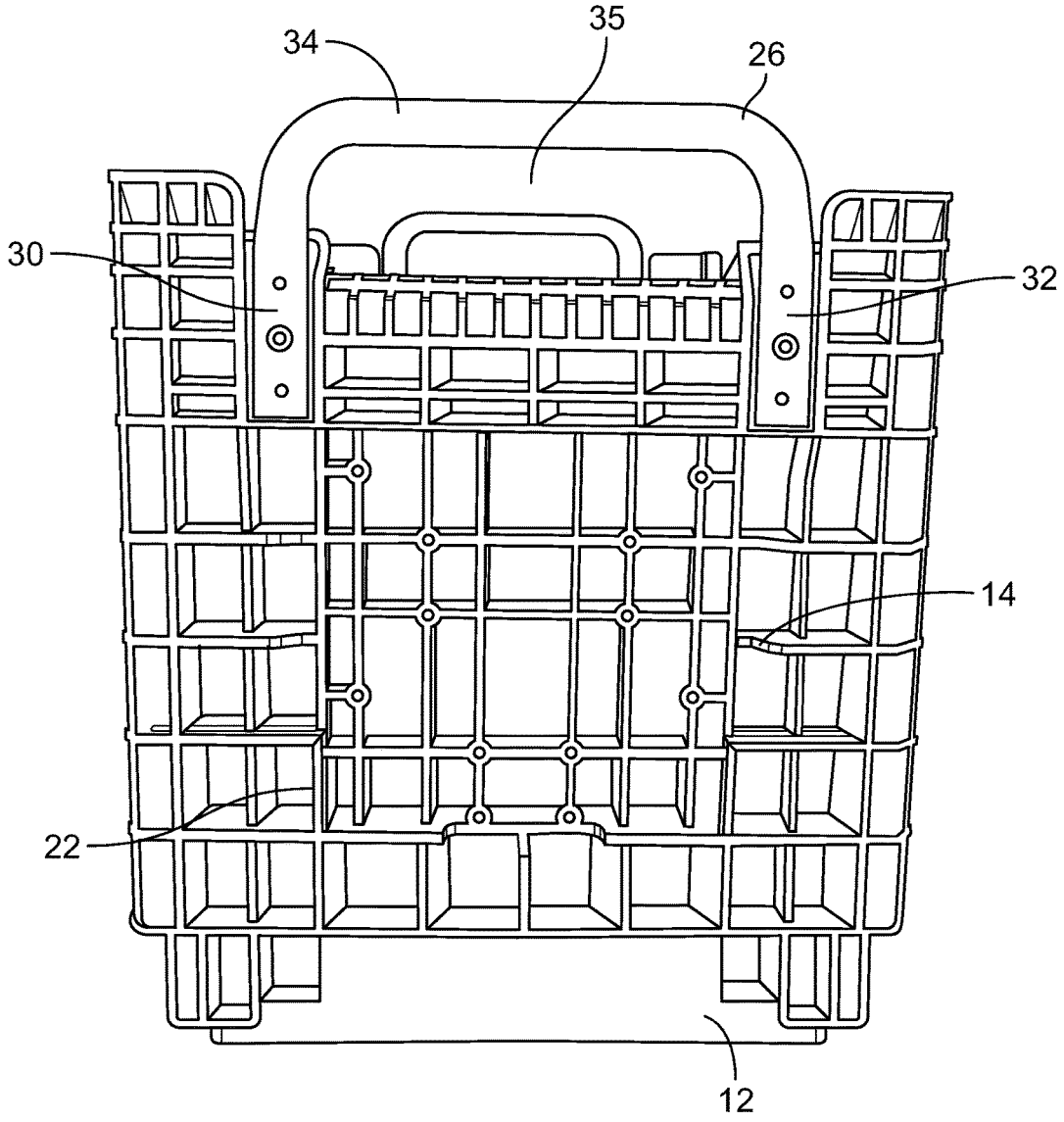
FIG. 2 is a plan view of one end of the tote style container of FIG. 1.

The handles 26, 28 of FIGS. 1 and 2 have flattened substantially vertical arms 30, 32. The horizontal bar 34 has a cylindrical cross-section. The handles 26, 28 can be made from a heavy duty plastic or can be metal.

Figure 3:
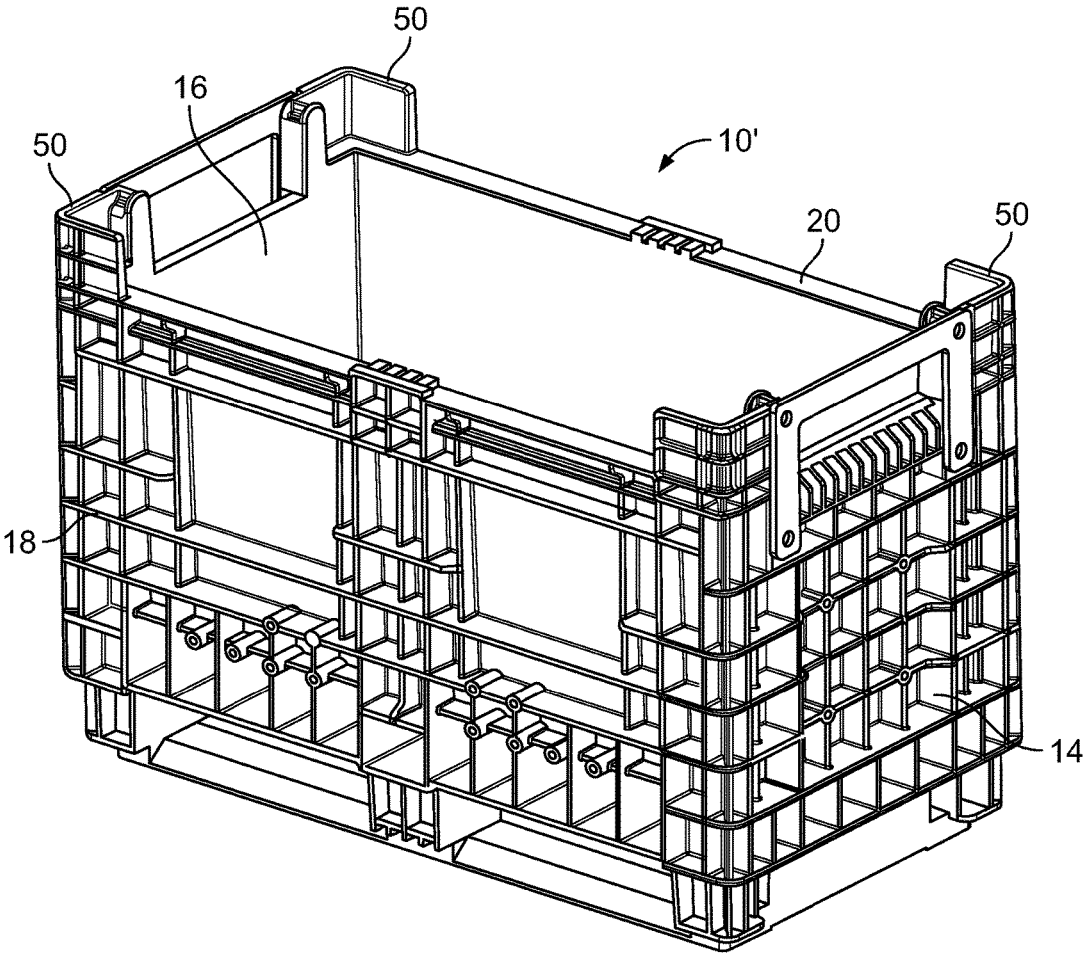
FIG. 3 is a perspective view of another embodiment of a tote style container with lift handles for a fork tine in accordance with the present invention.
Figure 4:
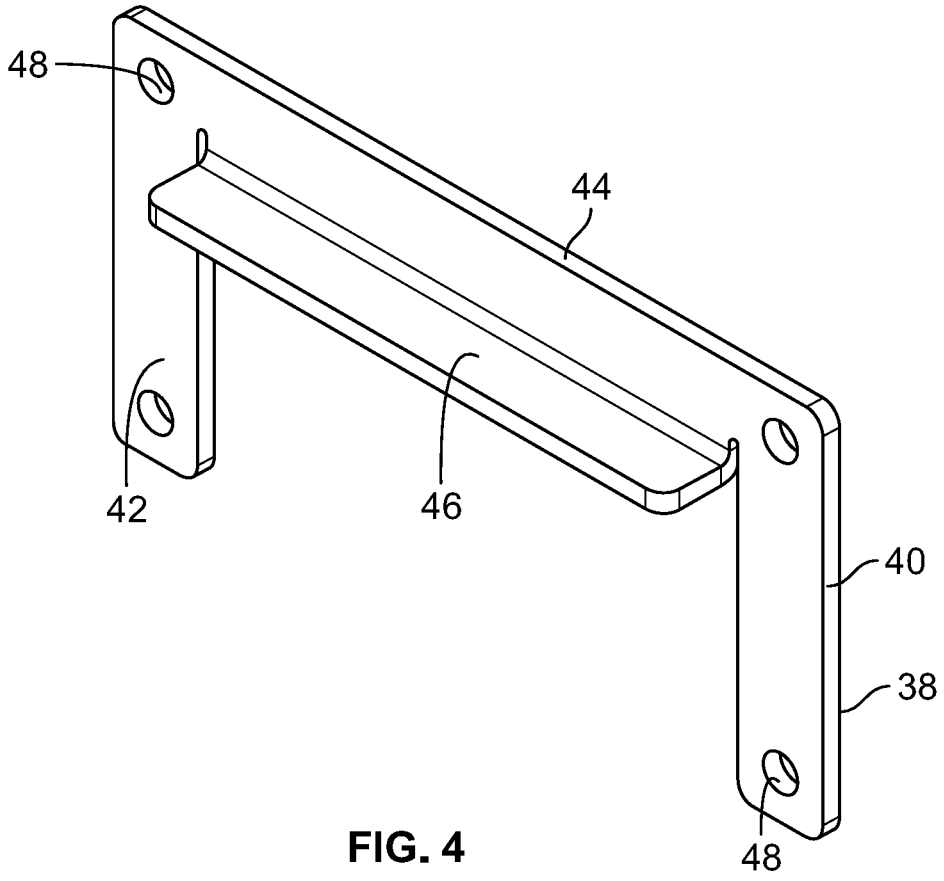
FIG. 4 is a perspective view of a handle of the embodiment of the tote style container of FIG. 3.

FIGS. 3 and 4 show an alternative embodiment of a tote style container 10' of the present invention. As illustrated in FIG. 4, the container 10' includes a handle 38 having a first arm 40, second arm 42 and horizontal bar 44 connected to the first arm 40 and to the second arm 42. The handle 38 also includes a flat segment 46 extending perpendicular from a bottom portion of the horizontal bar 44. The flat segment 46 contacts the flat upper surface of the tine of the fork lift during use. The handle 38 also includes a plurality of openings 48 for connecting the handle 38 to the container 10'.

As evident in FIG. 3, the container 10' includes corner portions 50 extending upward above the end walls 14, 16 and side walls 18, 20. The arms 40, 42 of the handle 38 can be mounted directly to the corner portions 50. In this embodiment, the horizontal bar 44 has a top edge aligned with the topmost edge of the corner portions 50. In the embodiment of FIGS. 1 and 2, the horizontal bar 34 of the handle is above the corner portions 50.

Each container is designed to allow a single tine of a fork truck to be inserted through the openings 35 to lift the container. The width of each end wall 14, 16 (i.e., the distance between the first side wall 18 and the second side wall 20) can be sized to allow two containers to be carried side-by-side on a fork lift using both fork tines (one for each container) having typical spacing.

Figure 5:
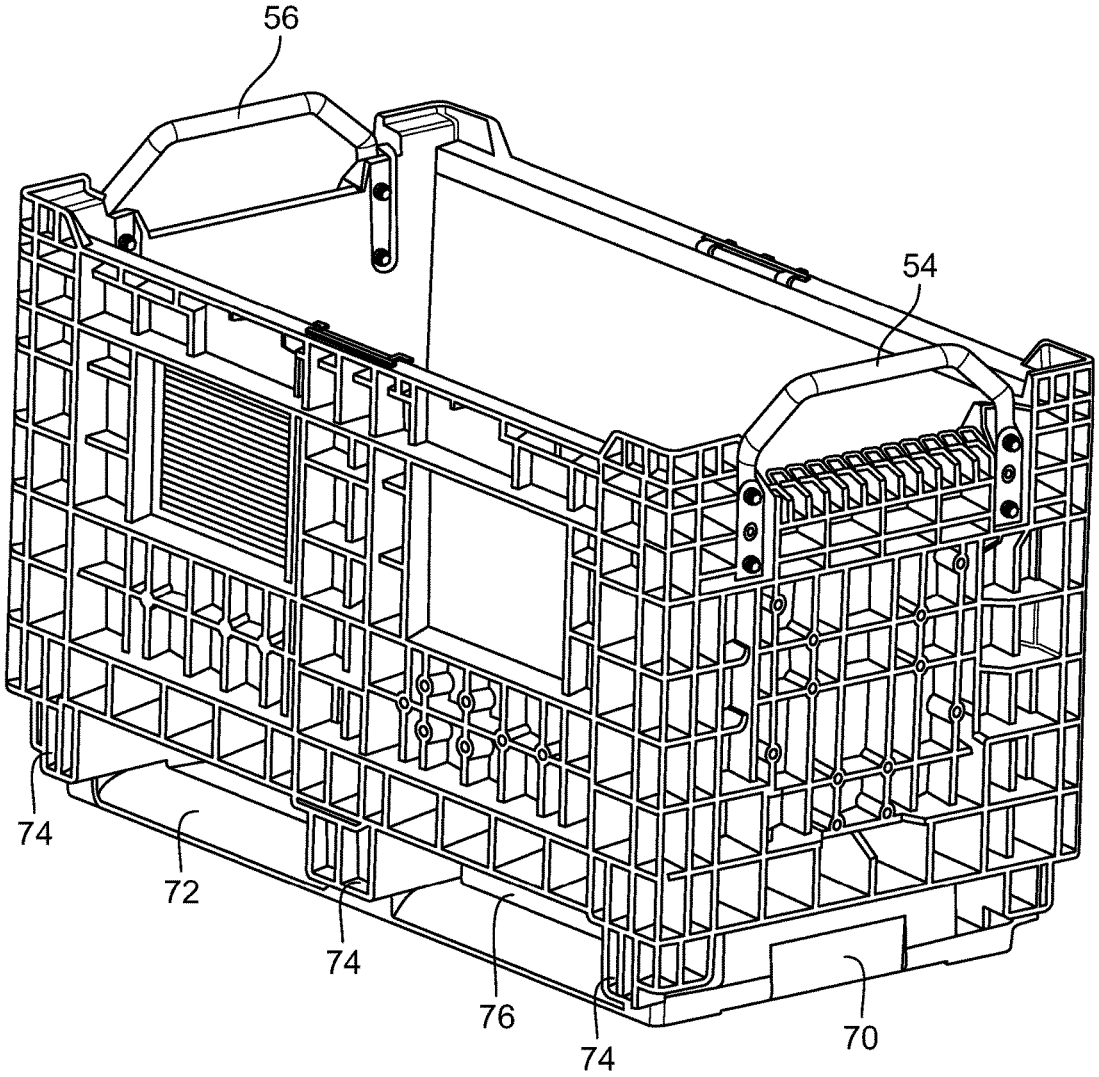
FIG. 5 is a perspective view of another embodiment of a tote style container with lift handles for a fork tine in accordance with the present invention.
Figure 6:
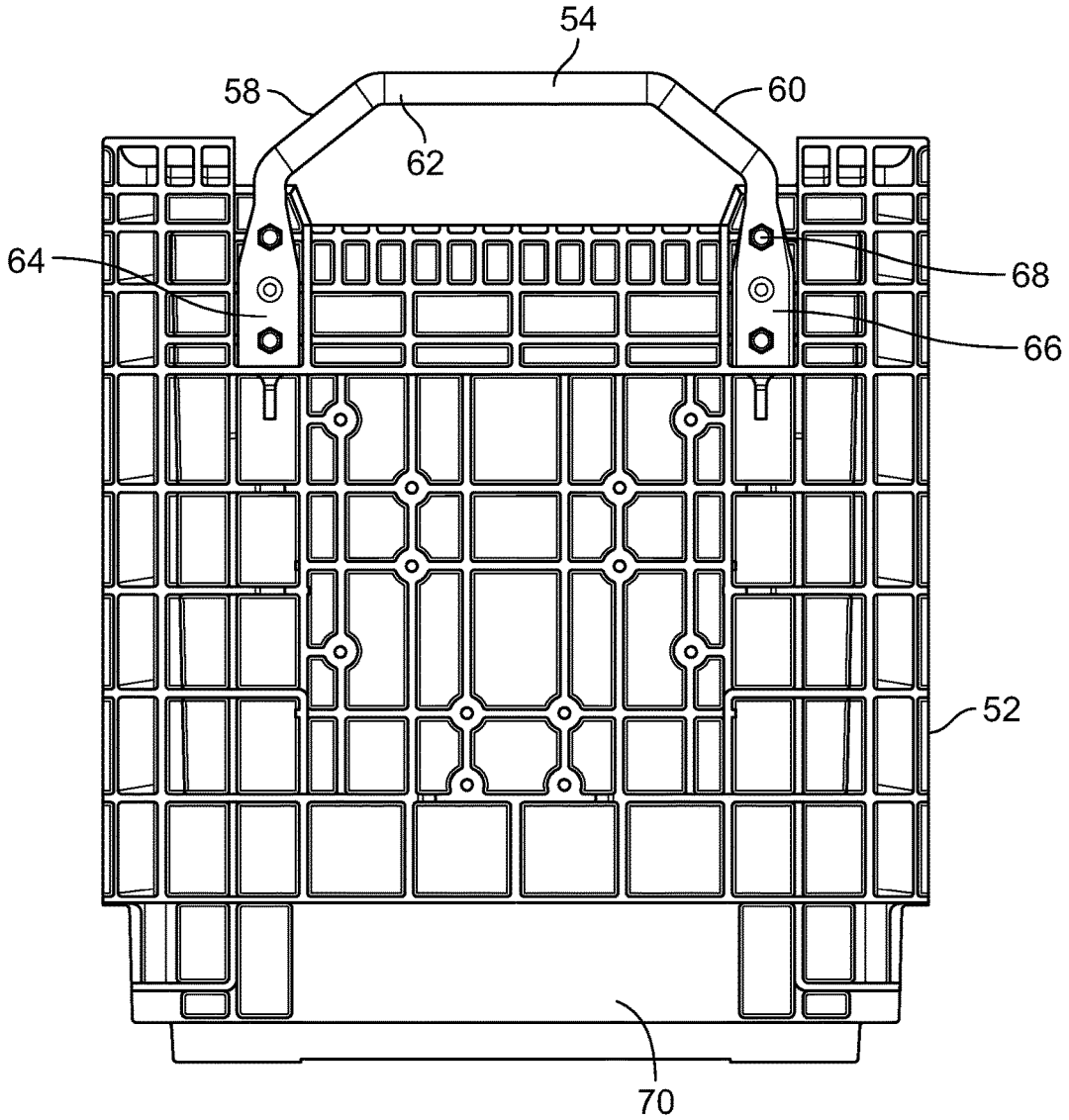
FIG. 6 is a plan view of one end of the tote style container of FIG. 5; and, FIG. 7 is a perspective view of the end of the tote style container of FIG. 5.
Figure 7:
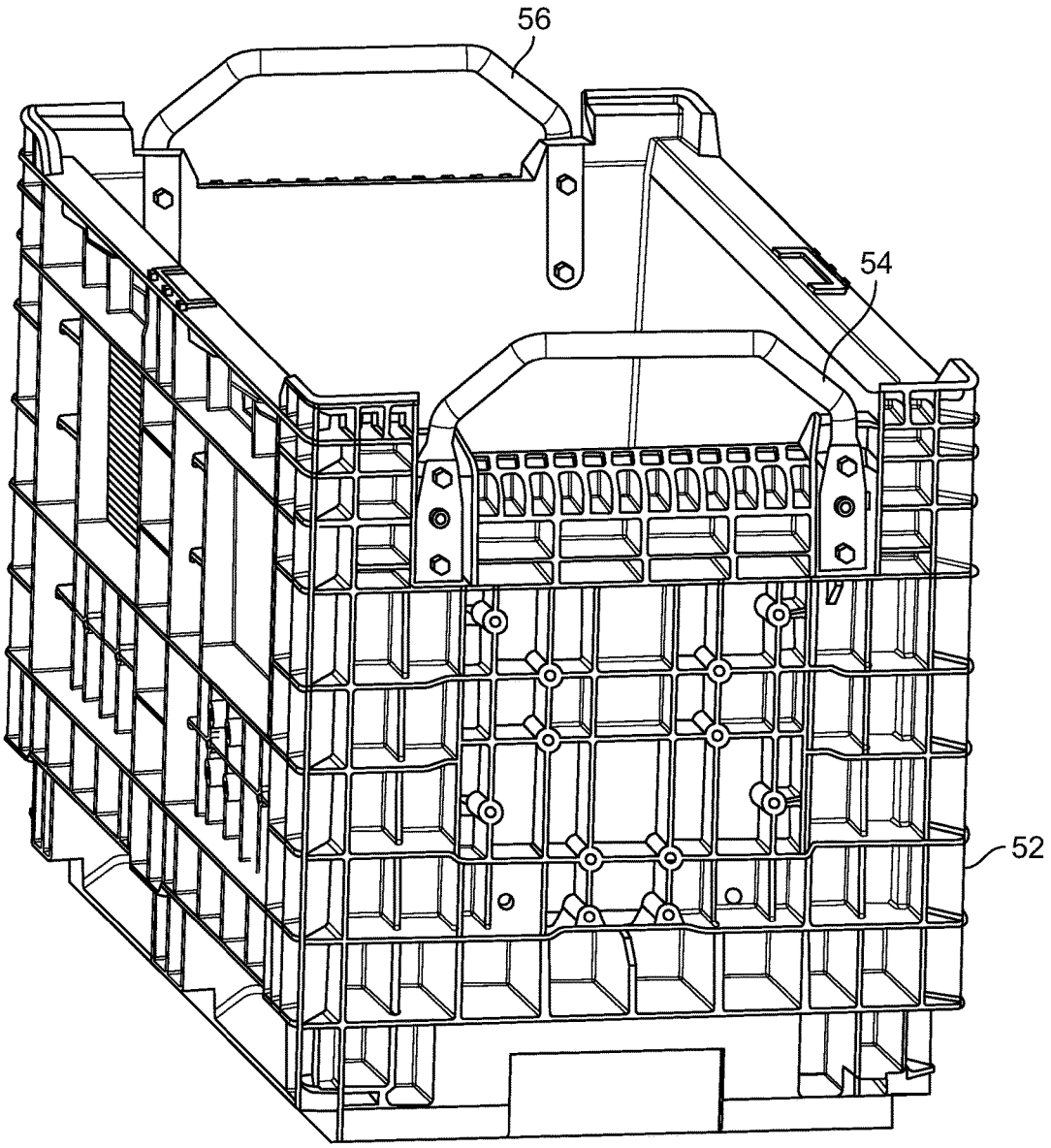

FIGS. 5-7 show another embodiment of a tote style container 52 in accordance with the present invention. As shown, the container 52 includes a first and second handle 54, 56 having two angled portions 58, 60 connecting a horizontal bar 62 to a first arm 64 and second arm 66. The arms 64, 66 are secured to the container with bolts 68.

The containers in each of the embodiments include a lower stringer 72 connecting a plurality of feet 74. The feet 74 extend down from the bottom wall of the container and with the stringer 72, form openings 76.

In any of the disclosed embodiments, the containers are designed (or can be modified) to stack with like containers when loaded. The container can be provided with a lower extension 70 that would block a fork tine from being used on a like container immediately below it. If all containers of the stack are identical (or at least substantially identical with respect to the features described herein), then only the top container of the stack would have openings for a fork tine. This would stop any attempt to lift all or part of a stack (greater than one) of such containers with a fork tine. It is undesirable to lift a stack of such containers with one fork tine because the stack could become unbalanced and tip.

Many modifications and variations of the present invention are possible in light of the above teachings. It is, therefore, to be understood within the scope of the appended claims the invention may be protected otherwise than as specifically described.

We claim:

1. A tote style container comprising:

a container body having a base, a first side wall, an opposing second side wall, a first end wall and an opposing second end wall and a plurality of outwardly extending ribs on the first end wall and the second end wall;

a first handle having an upper portion, a first arm and a second arm, the first arm and the second arm of the first handle securely mounted to a top portion of the first end wall, wherein each of the first arm and the second arm of the first handle is in a channel formed in the plurality of outwardly extending ribs, and forming a first opening between the top portion of the first end wall and the upper portion of the first handle, wherein the upper portion of the first handle is spaced above a top edge of the first side wall, a top edge of the second side wall, a top edge of the first end wall and a top edge of the second end wall;

a second handle having an upper portion, a first arm and a second arm, the first arm and the second arm of the second handle securely mounted to a top portion of the second end wall wherein each of the first arm and the second arm of the second handle is in a channel formed in the plurality of outwardly extending ribs, and forming a second opening between the top portion of the second end wall and the upper portion of the second handle where the second opening is aligned with the first opening, wherein the upper portion of the second handle is spaced above the top edge of the first side wall, the top edge of the second side wall, the top edge of the first end wall and the top edge of the second end wall, and wherein the first handle and the second handle are positioned and sized to receive a tine of a fork truck through the first opening and second opening.

2. The container of claim 1 wherein the container body is formed from plastic.

3. The container of claim 1 wherein each side walls include a plurality of outwardly extending ribs.

4. The container of claim 3 wherein the first side wall includes a flat portion for labels.

5. The container of claim 1 wherein the first handle is mounted to the first end wall by screws.

6. The container of claim 1 wherein the first handle is mounted to the first end wall by bolts.

7. The container of claim 1 wherein the upper portion of the first handle includes a flat segment extending inward.

8. The container of claim 7 wherein the upper portion of the second handle includes a flat segment extending inward.

9. The container of claim 1 wherein the first handle and the second handle are formed from metal.

10. A tote style container comprising:

a container body having a rectangular base, a first side wall, an opposing second side wall, a first end wall and an opposing second end wall, a first corner portion extending upward from the first end wall and the first side wall, a second corner portion extending upward from the first end wall and the second side wall, a third corner portion extending upward from the second end wall and the first side wall and a fourth corner portion extending upward from the second end wall and second side wall, a plurality of ribs extending from the first end wall and a plurality of ribs extending from the second end wall;

a first handle connected to the first end wall, the first handle having a horizontal bar extending from the first corner portion to the second corner portion to form an opening between the horizontal bar of the first handle and the first end wall, wherein the horizontal bar of the first handle is spaced above a top edge of the first side wall, a top edge of the second side wall, a top edge of the first end wall and a top edge of the second end wall, a first arm and a second arm; and, a second handle connected to the second end wall, the second handle having a horizontal bar extending from the third corner portion to the fourth corner portion to form an opening between the horizontal bar of the second handle and the second end wall, wherein the horizontal bar of the second handle is spaced above the top edge of the first side wall, the top edge of the second side wall, the top edge of the first end wall and the top edge of the second end wall, a first arm and a second arm and wherein the first opening and second opening are sized to receive a tine of a fork truck, and wherein each of the first arm and second arm of the first handle are in a channel formed in the plurality of ribs extending from the first end wall and each of the first arm and second arm of the second handle are in a channel formed in the plurality of ribs extending from the second end wall.

11. The tote style container of claim 10 wherein a top of the horizontal bar of the first handle is level with a top of the first corner portion and second corner portion, and a top of the horizontal bar of the second handle is level with a top of the third corner portion and fourth corner portion.

12. The tote style container of claim 10 wherein the horizontal bar of the first handle portion includes an upper planar portion and a lower planar portion substantially perpendicular to the upper planar portion, the lower planar portion extending toward an interior of the container.

13. The tote style container of claim 12 wherein the horizontal bar of the second handle portion includes an upper planar portion and a lower planar portion substantially perpendicular to the upper planar portion, the lower planar portion extending toward an interior of the container.

14. The tote style container of claim 10 wherein the horizontal bar of the first handle portion includes a first arm extending downward from a first end of the horizontal bar and a second arm extending downward from a second end of the horizontal bar.

15. The tote style container of claim 10 wherein each of the first end wall, second end wall, first side wall and second side wall include a plurality of ribs extending outward.

16. The tote style container of claim 10 wherein the container body comprises a plurality of feet extending downward from the base.

17. The tote style container of claim 16 wherein the container body comprises a first stringer and a second stringer.

18. The tote style container of claim 17 wherein the first stringer connects a first foot, a second foot and a third foot proximate the first side of the container and the second stringer connects a first foot, a second foot and a third foot proximate the second side of the container to form a first opening and a second opening.

19. The tote style container of claim 10 wherein the horizontal bar of the first handle is connected to a first angled portion extending downwardly on a first side and a second angled portion extending downwardly on a second side.

20. The tote style container of claim 19 wherein the first angled portion is connected to a downwardly extending vertical portion that is secured to the first end wall and the second angled portion is connected to a downwardly extending vertical portion that is secured to the first end wall.

* * * * *